US007676169B2

(12) United States Patent
Denton et al.

(10) Patent No.: US 7,676,169 B2
(45) Date of Patent: Mar. 9, 2010

(54) MULTIPATH TONER PATCH SENSOR FOR USE IN AN IMAGE FORMING DEVICE

(75) Inventors: Gary A. Denton, Lexington, KY (US); Cary Patterson Ravitz, Lexington, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 585 days.

(21) Appl. No.: 11/419,517

(22) Filed: May 22, 2006

(65) Prior Publication Data

US 2008/0056752 A1 Mar. 6, 2008

(51) Int. Cl.
*G03G 15/08* (2006.01)

(52) U.S. Cl. ..... 399/74; 399/49

(58) Field of Classification Search ..... 399/45, 399/49, 74, 389; 356/221, 222, 445; 250/559.11, 250/559.16, 559.44; 347/106
See application file for complete search history.

(56) References Cited

U.S. PATENT DOCUMENTS

| | | | | |
|---|---|---|---|---|
| 4,796,065 | A | 1/1989 | Kanbayashi | |
| 4,950,905 | A | 8/1990 | Butler et al. | |
| 5,083,161 | A | 1/1992 | Borton et al. | |
| 5,139,339 | A * | 8/1992 | Courtney et al. | 356/446 |
| 5,162,874 | A | 11/1992 | Butler | |
| 5,764,251 | A | 6/1998 | Hashimoto | |
| 6,628,398 | B1 | 9/2003 | Denton et al. | |
| 6,633,734 | B2 * | 10/2003 | Maebashi et al. | 399/49 |
| 6,914,684 | B1 * | 7/2005 | Bolash et al. | 356/600 |
| 2003/0043365 | A1 | 3/2003 | Ross et al. | |
| 2008/0170220 | A1 * | 7/2008 | Sawayama et al. | 356/73 |

FOREIGN PATENT DOCUMENTS

| | | | |
|---|---|---|---|
| JP | 62038348 | A * | 2/1987 |
| JP | 63075545 | A * | 4/1988 |
| JP | 63304281 | A * | 12/1988 |
| JP | 09247459 | A * | 9/1997 |
| JP | 2000250304 | A * | 9/2000 |
| JP | 2001180843 | A * | 7/2001 |

* cited by examiner

*Primary Examiner*—Robert Beatty

(57) ABSTRACT

A toner patch sensor for use in an image forming device may be operated in different modes according to the color of the patch being sensed. The toner patch sensor may include a detector and a source adapted to transmit light that is reflected off a toner patch and towards the detector. The detected light may be specular and/or diffuse. A controller may selectively change the amount of one or both of the specular and diffuse light received by the detector. The source may include separate emitters for the specular and diffuse light, with the controller selectably turning off one of the emitters or selectably adjusting a ratio of illumination power between the emitters. Alternatively, the source may include a single emitter and an optical element to split light between specular light and diffuse light. Diffuse light may be blocked when sensing black toner patches.

42 Claims, 7 Drawing Sheets

MULTIPATH TONER PATCH SENSOR FOR USE IN AN IMAGE FORMING DEVICE

BACKGROUND

The electrophotography (EP) process used in some imaging devices, such as laser printers and copiers, is susceptible to variations due to environmental changes and component life. This variability may have a greater impact on color EP printers since it may cause changes in the toner density of developed images, which in turn causes objectionable color shifts. It is general practice in the industry to incorporate sensors that measure the toner density of test images and provide feedback to the control system for making adjustments to various bias voltages and/or laser power. Ideally, these adjustments increase or decrease the amount of toner developed out to the latent image to achieve a desired density. Some conventional sensors currently used in the industry are reflective sensors that range from a simple emitter-detector arrangement to more complex arrangements. For instance, some sensors incorporate light-integrating cavities and collimated light sources. A limiting factor of the known art is the ability to tune the sensor to the toner that is being measured. As an example, the color toners cyan, magenta, and yellow are transparent to infrared light and reflect light in a diffuse manner. Conversely, black toner, which often includes carbon black pigment, absorbs infrared light. This absorption results in a reduction of specular light reflected off the substrate. Accordingly, conventional sensors may not be optimally suited for use in color EP printers.

SUMMARY

Various embodiments disclosed herein are directed to EP image forming devices and an improved toner patch sensor that uses multiple light paths that are selectably activated depending on the color of a toner patch being measured. The toner patch sensor may include a detector and a source adapted to transmit light that is reflected off a toner patch and towards the detector. The source may be oriented so that the reflected light is specular and/or diffuse. A controller may selectively change the amount of one or both of the specular and diffuse light received by the detector. The source may include separate emitters for the specular and diffuse light, with the controller selectably turning off one of the emitters or selectably adjusting a ratio of illumination power between the emitters. Alternatively, the source may include a single emitter and an optical element to split light between paths that reflect specular light and diffuse light towards the detector. Diffuse light may be blocked when sensing black toner patches. Specular light and diffuse light may be transmitted to the detector when sensing toner patches with a color other than black.

DETAILED DESCRIPTION

Figure 1:
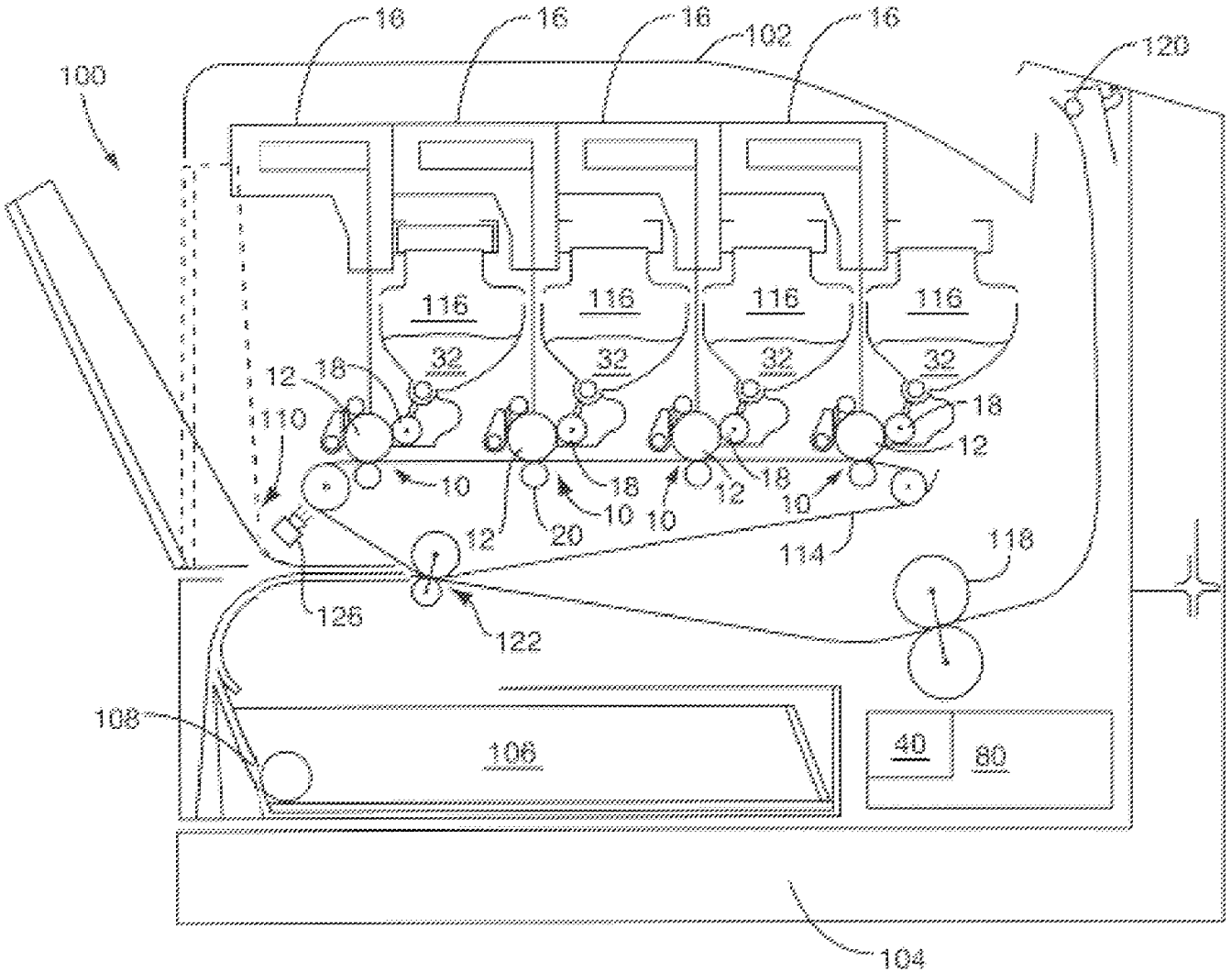
FIG. 1 is a functional block diagram of an image forming apparatus according to one embodiment.

Embodiments disclosed herein are directed to a toner patch sensor that may be used to measure toner density and provide feedback that is used in adjusting operating parameters to consistently develop an appropriate amount of toner during the image formation process. This type of optimization can be performed in a device such as the image forming apparatus as generally illustrated in FIG. 1. Specifically, FIG. 1 depicts a representative dual-transfer image forming device, indicated generally by the numeral 100. The image forming device 100 comprises a housing 102 and a media tray 104. The media tray 104 includes a main stack of media sheets 106 and a sheet pick mechanism 108. The image forming device 100 also includes a multipurpose tray 110 for feeding envelopes, transparencies and the like. The media tray 104 may be removable for refilling, and located in a lower section of the device 100.

Within the image forming device housing 102, the image forming device 100 includes one or more removable developer cartridges 116, photoconductive units 12, developer rollers 18 and corresponding transfer rollers 20. The image forming device 100 also includes an intermediate transfer member (ITM) belt 114, a fuser 118, and exit rollers 120, as well as various additional rollers, actuators, sensors, optics, and electronics (not shown) as are conventionally known in the image forming device arts, and which are not further explicated herein. Additionally, the image forming device 100 includes one or more system boards 80 comprising controllers (including controller 40 described below), microprocessors, DSPs, or other stored-program processors (not specifically shown in FIG. 1) and associated computer memory, data transfer circuits, and/or other peripherals (not shown) that provide overall control of the image formation process.

Each developer cartridge 116 may include a reservoir containing toner 32 and a developer roller 18, in addition to various rollers, paddles and other elements (not shown). Each developer roller 18 is adjacent to a corresponding photoconductive unit 12, with the developer roller 18 developing a latent image on the surface of the photoconductive unit 12 by supplying toner 32. In various alternative embodiments, the photoconductive unit 12 may be integrated into the developer cartridge 116, may be fixed in the image forming device housing 102, or may be disposed in a removable photoconductor cartridge (not shown). In a typical color image forming device, four colors of toner—cyan, magenta, yellow, and black—are applied successively (and not necessarily in that order) to a print media sheet 106 to create a color image. Correspondingly, FIG. 1 depicts four image forming units 10. In a monochrome printer, only one forming unit 10 may be present.

The operation of the image forming device 100 is conventionally known and is not explicitly described herein. For a thorough description of a conventional image forming device, reference is made to commonly assigned, co-pending U.S. patent application Ser. No. 11/240,217 filed Sep. 30, 2005, the contents of which are hereby incorporated by reference. The representative image forming device 100 shown in FIG. 1 is referred to as a dual-transfer device because the developed images are transferred twice: first at the image forming units 10 and second at the transfer nip 122. Other image forming devices implement a single-transfer mechanism where a media sheet 106 is transported by a transport belt (not shown) past each image forming unit 10 for direct transfer of toner images onto the media sheet 106. For either type of image forming device, there may be one or more toner patch sensors 126, to monitor a media sheet 106, and ITM belt 114, a photoconductive unit 12, or a transport belt (not shown), as appropriate, to sense various test patterns printed by the various image forming units 10 in an image forming device 100. The toner patch sensors 126 may be used for, among other purposes, registering the various color planes printed by the image forming units 10. In one embodiment, two toner patch sensors 126 may be used, with one at opposite sides of the scan direction (i.e., transverse to the direction of substrate travel).

Figure 2:
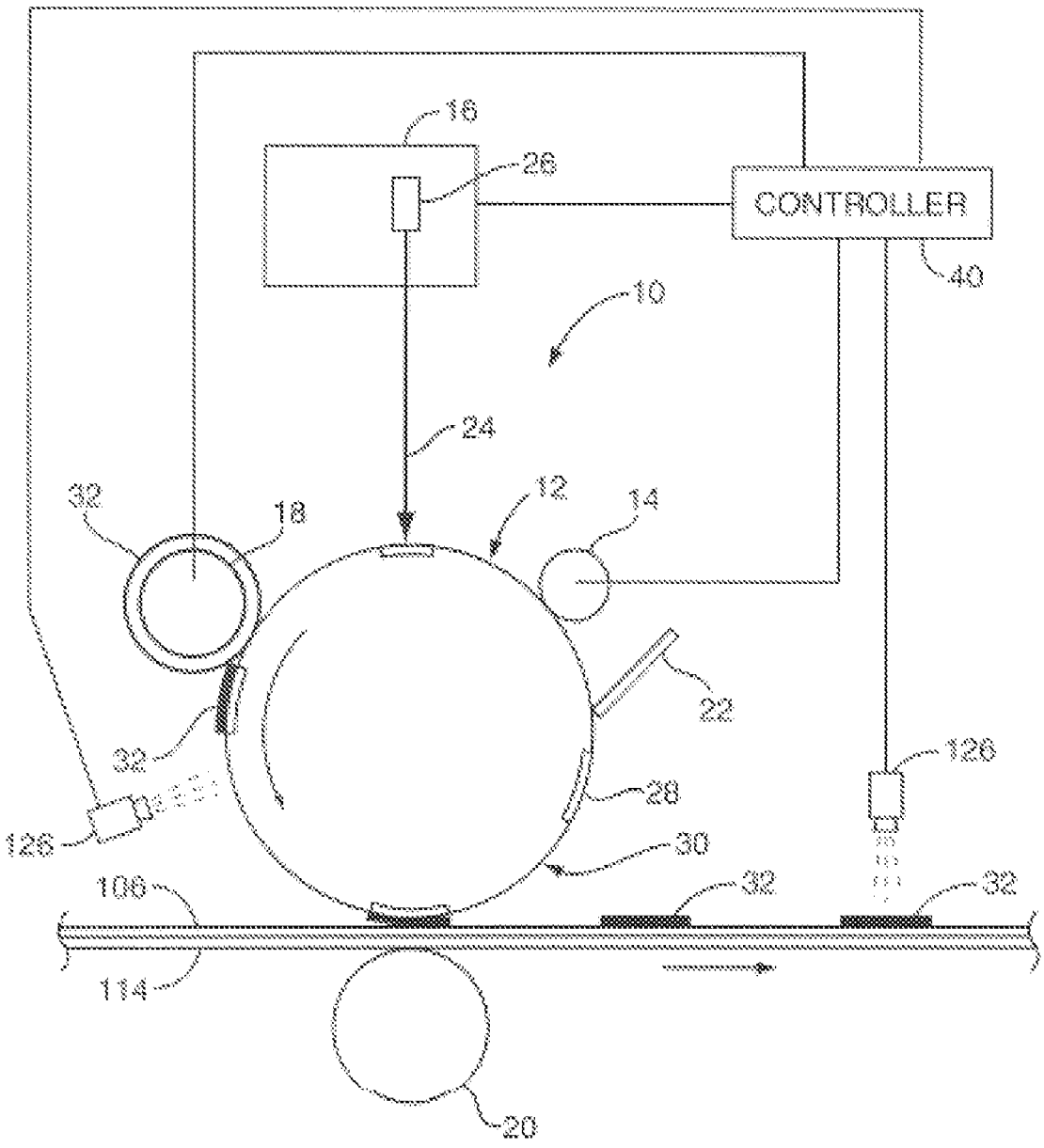
FIG. 2 is a schematic diagram of an image forming unit and toner patch sensing controller according to one embodiment.

FIG. 2 is a schematic diagram illustrating an exemplary image forming unit 10. Each image forming unit 10 includes a photoconductive unit 12, a charging unit 14, an optical unit 16, a developer roller 18, a transfer device 20, and a cleaning blade 22. The charging unit 14 may charge the surface of the photoconductive unit 12. A laser beam 24 from a laser source 26 in the optical unit 16 selectively discharges discrete areas 28 on the photoconductive unit 12. The latent image thus formed on the photoconductive unit 12 is then developed with toner from the developer roller 18. The developed image is subsequently transferred to a media sheet 106 passing between the photoconductive unit 12 and the transfer device 20. Alternatively, the developed image may be transferred to an ITM belt 114 and subsequently transferred to a media sheet 106 at a second transfer location (not shown in FIG. 2, but see location 122 in FIG. 1).

The above description relates to an exemplary image forming unit 10. In any given application, the precise arrangement of components, voltages, and the like may vary as desired or required. As is known in the art, an electrophotographic image forming device may include a single image forming unit 10 (generally developing images with black toner), or may include a plurality of image forming units 10, each developing a different color plane separation of a composite image with a different color of toner (generally cyan, magenta, yellow, and black).

The density of toner 32 that is supplied by the developer roller 18 to develop the latent image areas 28 is measured using one or more toner patch sensors 126. The density of the toner 32 is checked because the effectiveness of toner development varies due to environmental conditions, differing toner formulations, component variation, difference in age or past usage levels of various components, and the like. Controller 40, via sensor 126, monitors toner 32 formation on media sheet 106 or belt 114 and may adjust the surface potential of the surface of photoconductive unit 12 (via charging unit 14) or the surface potential of developer roller 18 or imaging device 16 power levels.

In an exemplary embodiment, controller 40 at least partially manages the formation of a predetermined pattern of toner 32 on a substrate, which may comprise a media sheet 106 or belt 114 (e.g., a transfer or ITM belt). A toner patch sensor 126 detects a reflectance of the transferred pattern and controller 40 adjusts the bias voltage of the charging unit 14 and/or developer roller 18, and/or imaging device 16 power levels as needed to optimize image formation at least partly based on information provided by the toner patch sensor 126. The toner patch sensor 126 may be configured to sense the developed patterns 32 and a substrate 106, 114. Additionally, or alternatively, the toner patch sensor 126 may be configured to sense the developed patterns 32 on the surface of the photoconductive unit 12. Generally, the toner patch sensor 126 may be disposed adjacent any toner carrying surface to sense the reflectance of toner 32, the underlying toner carrying surface, or both. Also, in certain instances, it may be desirable to print toner on toner images (e.g., black on yellow or other combinations) to achieve greater contrast between the developed image and the toner carrying surface. Thus, the toner carrying surface may comprise a solid toner patch of a different color disposed on the substrate 106, 114 or the photoconductive unit 12. Controller 40 establishes an operating point that will optimize toner density. Further, the controller 40 may adjust operating points based not only upon toner patch sensor 126 readings for solid toner patches, but also various halftone patterns in an effort to optimize halftone linearization. Accordingly, a brief description of the optimization process is provided below.

Initially, one or more solid toner patches 32 are developed and transferred to the substrate 106, 114 to determine appropriate bias levels for developer roller 18 and charging unit 14 as well as an appropriate power level for the imaging device 16. The solid toner patches 32 are transported towards toner patch sensor 126, which measures a reflectance of the solid toner patch 32. A series of toner patches are produced over a range of developer bias 18 values and/or imaging devices 16 power levels and the reflectance of each patch is measured by the toner patch sensor 120. Data from empirical testing is used to correlate the toner patch reflectance values to the target mass of the solid area on the page. The controller 40 then adjusts the developer bias 18 values and/or imaging devices 16 power levels to achieve the target mass of the solid area.

After selecting an appropriate combination of charge bias, discharge exposure energy, and developer roll bias, controller 40 manages the implementation of a halftone linearization where desired color halftone screen corrections are obtained to achieve a linear halftone response. Color imaging devices sometimes use halftone screens to combine a finite number of colors (usually four) to produce many shades of colors. In order to print different colors, they are separated into several monochrome layers for different colorants, each of which is then halftoned. The halftone process converts different tones of an image into spatial dot patterns that fill some percentage of a given screen. Smaller halftone percentages are produced by smaller dots in a halftone screen. Conversely, larger halftone percentages are produced by larger dots in a halftone screen.

Ideally, the image forming device 10 will produce halftones screens that comprise theoretically desired amounts of toner 32 relative to the underlying substrate 106, 114. For example, a 50% halftone pattern should theoretically comprises about half toner 32 and half substrate 106, 114. The halftone linearization process measures reflectivity values for various halftone percentages and calculates halftone screen corrections that are necessary to adjust the actual halftone screens towards ideal values.

Figure 3:
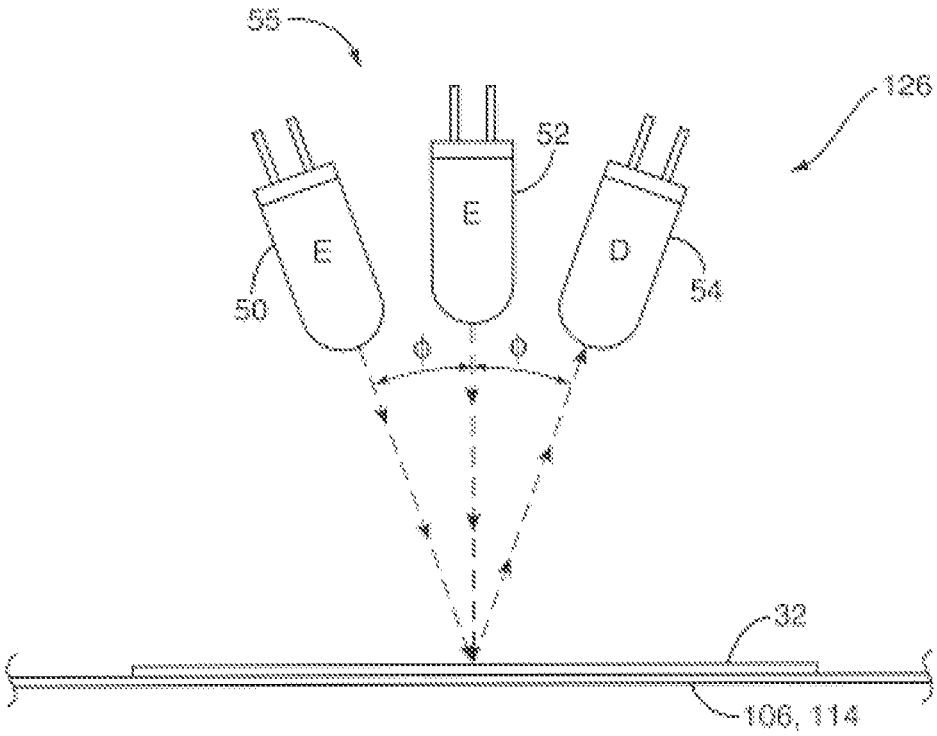
FIG. 3 is a schematic illustration of a toner patch sensor according to one embodiment.

In light of the foregoing optimization procedures, a toner patch sensor 126 as shown in FIG. 3 may be used in the exemplary image forming device 10 to obtain the necessary reflectivity values used by controller 40 to establish optimal operating points. The exemplary toner patch sensor 126 includes a light source 55 that includes two emitters 50, 52 (labeled in FIG. 3 with the letter E) and one detector 54 (labeled with the letter D). The emitters 50, 52 are arranged to transmit light that is reflected off the surface of the toner 32 as both specular and diffuse light towards the detector 54. Emitter 50 is identified as the specular emitter while emitter 52 is identified as the diffuse emitter. In one embodiment, the emitters 50, 52 are identical to each other. In one embodiment, the emitters are infrared LED sources, though it should be understood that the sources may be constructed of other types of light sources, including but not limited to laser, incandescent, chemoluminescent, gas-discharge, and emit ultraviolet, visible or near visible light. The use of a single detector 54 may simplify toner patch sensing and eliminate a need to combine detector outputs as is required by some conventional systems. In one embodiment, detector 54 is a photosensitive diode, though other types of detectors, including for example, photocells, phototransistors, CCDs, or CMOS detectors may be used. Accordingly, as used herein, the term "light" should be generally interpreted to mean electromagnetic radiation with a wavelength that detectable by the detector 54.

The emitters 50, 52 may be identified as specular or diffuse by nature of their orientation relative to the detector 54. The term "specular" is generally understood to mean mirror-like or capable of reflecting light like a mirror. Accordingly, the specular emitter 50 is oriented at an incident angle Φ relative to a direction normal to the measurement surface (e.g., toner patch 32 or substrate 106, 114) and that is substantially the same as a reflectance angle Φ at which the detector 54 is oriented. Notably, the incident angle Φ and reflectance angle Φ are equal but opposite relative to the direction normal to the measurement surface. Accordingly, a substantial amount of energy emitted by the specular emitter 50 may be measurably detected by the detector 54. For the sake of size, the incident and reflectance angle Φ may be within a range between about 10 degrees and about 45 degrees relative to a direction that is normal to the measurement surface (32, 106, 114). Angles outside this range are certainly permissible.

By comparison, the diffuse emitter 52 is oriented so that the incident and reflectance angles are not the same. In one embodiment, the diffuse emitter 52 is oriented to project light along a direction substantially normal to the toner patch 32 (or substrate 106, 114). Accordingly, while a majority of the light emitted from the diffuse emitter 52 may not reach the detector 54, some measurable scattered energy (due in part to the scattering of light by the measured toner 32) will reach the detector 54.

In the present embodiment shown in FIG. 3, the specular and diffuse emitters 50, 52 are implemented as separate elements. Accordingly, each may be controlled individually for measuring different color toner patches. For instance, the power that is supplied to each emitter 50, 52 may be varied depending on which colors are being sensed. In one or more embodiments, the illumination power ratio between the specular emitter 50 and diffuse emitter 52 may be adjusted to some intermediate values other than ON/OFF for optimum response. In one implementation, both may be turned on during the process of sensing certain colors while one or the other is turned off during the process of sensing other colors. For example, in one embodiment, the specular emitter 50 may be turned on during the process of sensing all colors while the diffuse emitter 52 may be turned on during the process of sensing colors other than black. Empirical tests have shown that this latter configuration provides improved detector sensitivity to toner density. It may be desirable to operate the diffuse emitter 52 with a duty cycle approximately 25 percent on time and to sample the detector signal only when this emitter is on for color toner patches and only when it is off for black toner patches.

Figure 4:
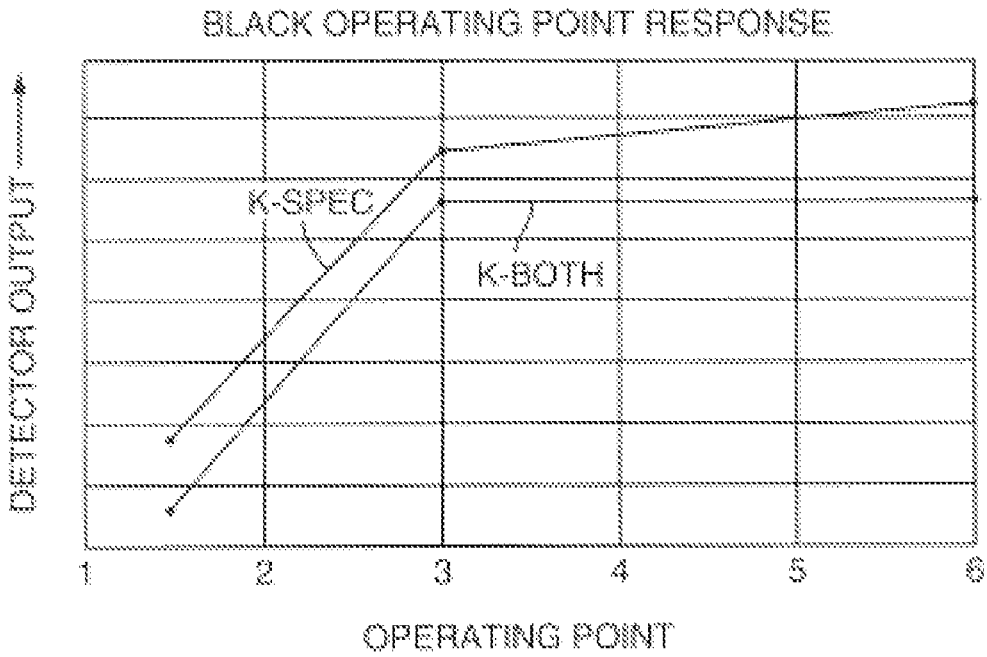
FIG. 4 is a graphical depiction of operating point response for a toner patch sensor operated in different modes to sense black toner.
Figure 5:
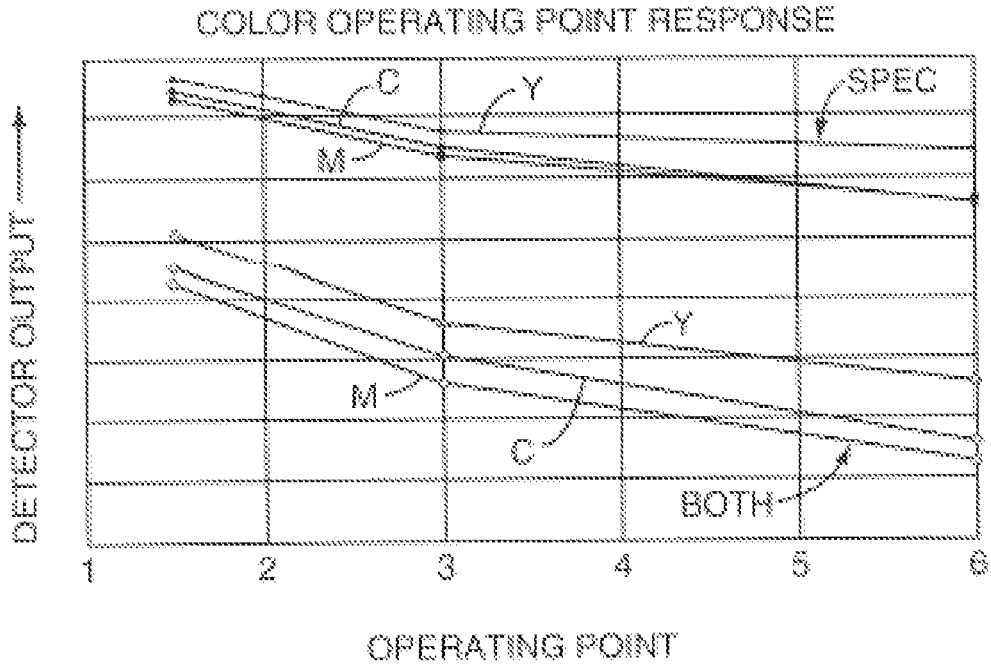
FIG. 5 is a graphical depiction of operating point response for a toner patch sensor operated in different modes to sense color toner.

FIGS. 4 and 5 illustrate detector 54 responses to different operating points. Specifically, FIGS. 4 and 5 reveal how the detector 54 output changes in response to different operating points depending on whether the specular emitter 50 alone or both the specular and diffuse emitters 50, 52 are powered during toner patch sensing. The horizontal axis in each Figure represents discrete operating points where different values for developer roller 18 bias and/or imaging device 16 power are applied. For example, the developer roller 18 may be biased to different voltages falling within a range between about −300 volts and about −700 volts, with each operating point representing some intermediate value within this range. In one embodiment, each operating point may represent some intermediate value falling between about −500 volts and about −600 volts. As discussed earlier, these representative voltages vary among device manufacturers and may vary depending upon a number of factors, including toner composition, component geometry, and component materials.

In addition, or instead, each operating point may reflect a change in imaging device 16 power. For instance, each operating point may have an associated power level that is some fraction (e.g., a PWM duty cycle) of full power for an imaging device 16 capable of producing an exposure level of about 1.1 micro-Joules per square centimeter at 100% power. Thus, for example, each operating point may represent some intermediate value falling between about 30% and 90% of full power. Other values and ranges are certainly permissible and expected for different forming devices 10.

Notably, the precise values for the operating points used in FIGS. 4 and 5 are less important than the response to the different operating points. Generally, it may be advantageous to select a configuration that produces a greater variation in detector output over a set of operating points. As discussed above, toner patch sensing may be performed to obtain operating points that produce a target reflectance from a toner patch. Consequently, greater variation over different operating points lends itself to greater adjustability and optimization over time and over different environments.

The vertical axis shown in FIGS. 4-7 represents a detector output, and may represent reflectance of the toner patch 32. In one embodiment, a reflectance may be measured and converted to a predicted luminance or chroma value for the fused toner on paper based upon predetermined empirical data. In any event, the detector output correlates to the amount of energy that is transmitted by the emitters 50, 52 and received by the detector 54.

FIG. 4 represents test performed on black (K) toner patches 32. In FIG. 4, the upper curve K-SPEC represents a curve fit between data points obtained when only the specular emitter 50 is used. The lower curve K-BOTH represents a curve fit between data points obtained when both the specular emitter 50 and the diffuse emitter 52 are used. Both curves K-SPEC and K-BOTH show relatively large output variation between operating points 1 and 3. However, the lower curve K-BOTH is characterized by a substantially flat response between operating points 3 and 6. In this same region, the upper curve K-SPEC varies, albeit at a slower rate than between operating points 1 and 3. Regardless, FIG. 4 shows that greater adjustability may be provided through use of the specular emitter 50 alone when measuring black toner patches.

In contrast to the results in FIG. 4, the results plotted in FIG. 5 show that greater operating point adjustability may be provided through use of both the specular emitter 50 and the diffuse emitter 52 when measuring toner patches for colors other than black. FIG. 5 includes curves for colors Cyan (C), Magenta (M), and Yellow (Y). The upper set of curves labeled SPEC represent detector outputs obtained when only the specular emitter 50 is used. In contrast, the lower set of curves labeled BOTH represent detector outputs obtained when both the specular and diffuse emitters 50, 52 are used in patch sensing. Specifically, FIG. 5 shows greater variance between the beginning and ending operating points for the three color curves (bottom of FIG. 5) obtained with both emitters 50, 52 as compared to the curves (top of FIG. 5) obtained when only the specular emitter 50 is used. These results are in contrast with those shown in FIG. 4. Accordingly, in one embodiment, toner patch sensing may be performed with only the specular emitter 50 used for black toner patch sensing while both specular and diffuse emitters 50, 52 are used for toner patch sensing for colors other than black.

Figure 6:
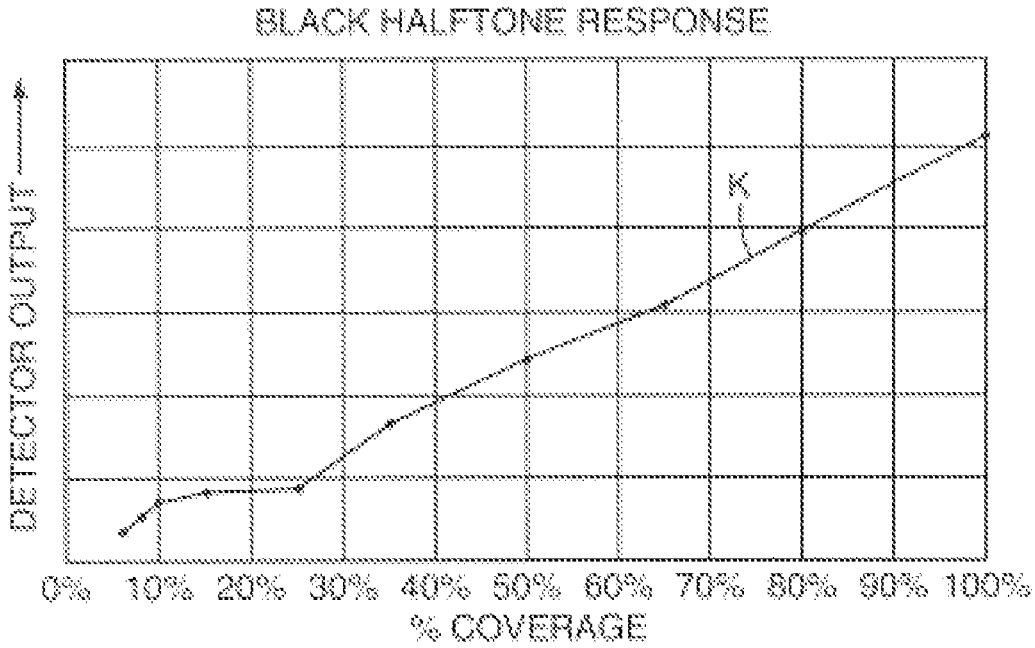
FIG. 6 is a graphical depiction of black halftone response for a toner patch sensor operated with only a specular source.
Figure 7:
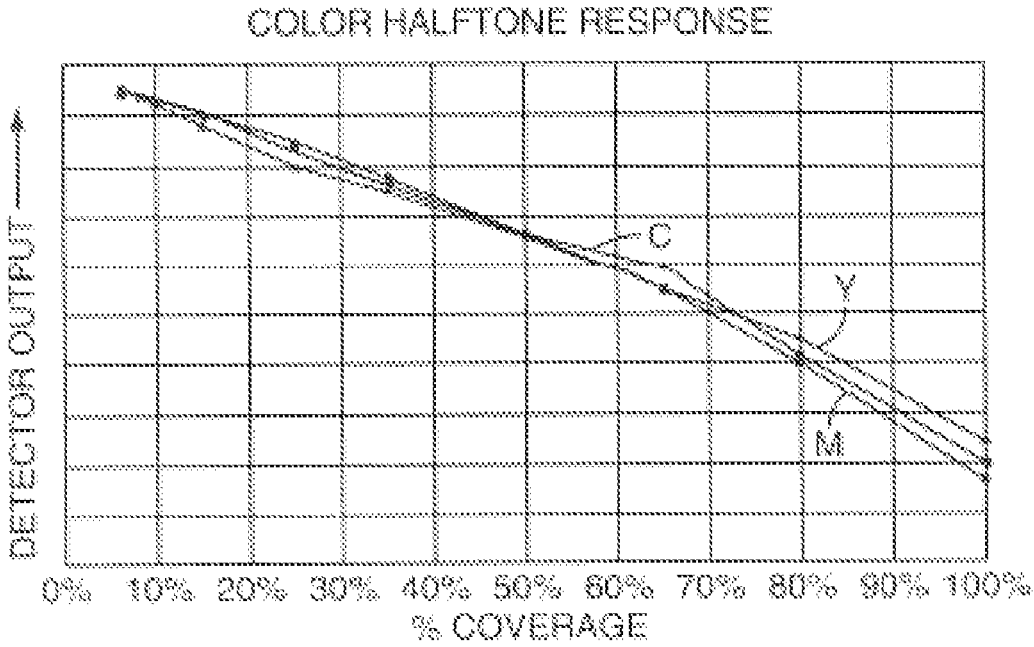
FIG. 7 is a graphical depiction of color halftone response for a toner patch sensor operated with a specular source and a diffuse source.

As discussed above, toner patch sensing may be used for halftone linearization as well as toner density optimization. Accordingly, it follows that the detector output should produce a measurable variation over all or a substantial majority of all halftone patterns. FIGS. 6 and 7 confirm that the configuration selected pursuant to the results obtained in FIGS. 4 and 5 produces a suitable halftone response. That is, FIG. 6 shows that the detector output monotonically varies according to percentage of halftone coverage when black halftone patterns are sensed using a specular emitter 50 alone. Testing has shown that if both the specular emitter 50 and diffuse emitter 52 are used to sense black halftones, the detector output varies very little at small halftone percentages. In other words, halftone coverages below about 20 percent become indistinguishably different if both the specular emitter 50 and diffuse emitter 52 are used to sense black halftones. FIG. 7 shows that the detector output monotonically varies according to percentage of halftone coverage when halftone patterns other than black are sensed using both the specular emitter 50 and the diffuse emitter 52.

Figure 8:
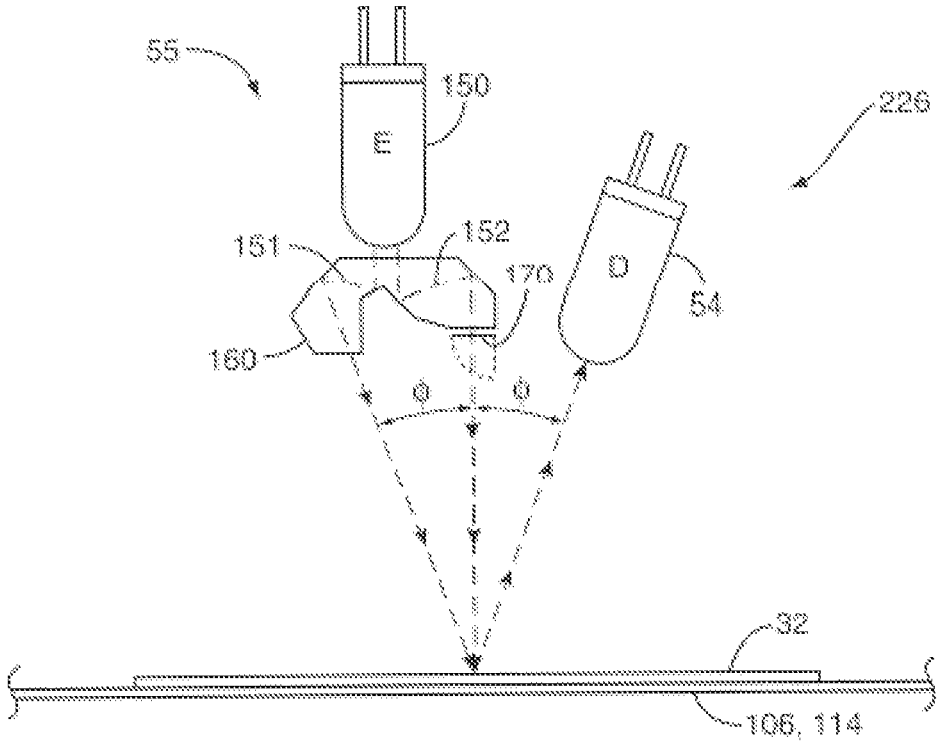
FIG. 8 is a schematic illustration of a toner patch sensor according to one embodiment.

In the embodiment shown in FIG. 3, the toner patch sensor 126 included two separate emitters 50, 52. In alternative embodiments, such as those provided in FIGS. 8 and 9, a light source 55 including a single emitter 150 may be used in conjunction with an optical element that splits the optical energy emitted by the emitter 150 into specular and diffuse paths. In FIG. 8, the toner patch sensor 226 includes a single emitter 150, a single detector 54 associated with the emitter 150, and an optical element 160. The optical element 160 may be a prism, a light tube, or other internally reflecting element that diverts optical energy emitted from the emitter 150 along different optical paths 151, 152. The first path 151 is a specular path that is characterized by the angle of incidence Φ as described above. The second path 152 is a diffuse path oriented to project light along a direction substantially normal to the toner patch 32 (or substrate 106, 114) as described above. One or more surfaces of the optical element 160 may be filtered or otherwise processed to alter the amount or nature of the light traveling along the specular 151 or diffuse 152 paths.

As disclosed above, the diffuse emitter 52 may be turned off when black toner patch sensing is performed. Accordingly, the present embodiment of the toner patch sensor 226 may be implemented with a screen 170 that selectably blocks light traveling along the diffuse path 152. The screen 170 may be selectably switched between the solid line position shown in FIG. 8 and an open position (shown in dashed lines) where light traveling along the diffuse path 152 is allowed to reach the toner patch 32 and ultimately reach the detector 54. In an unillustrated embodiment, one or more screens 170 may be associated with each transmission path 151, 152, the different screens having different filtering characteristics to adjust the ratio of light transmission received by the detector 54 from each path 151, 152. Further, one or more screens 170 may also be used with the multi-emitter embodiments disclosed herein (e.g., FIG. 3 or FIG. 10).

Figure 9:
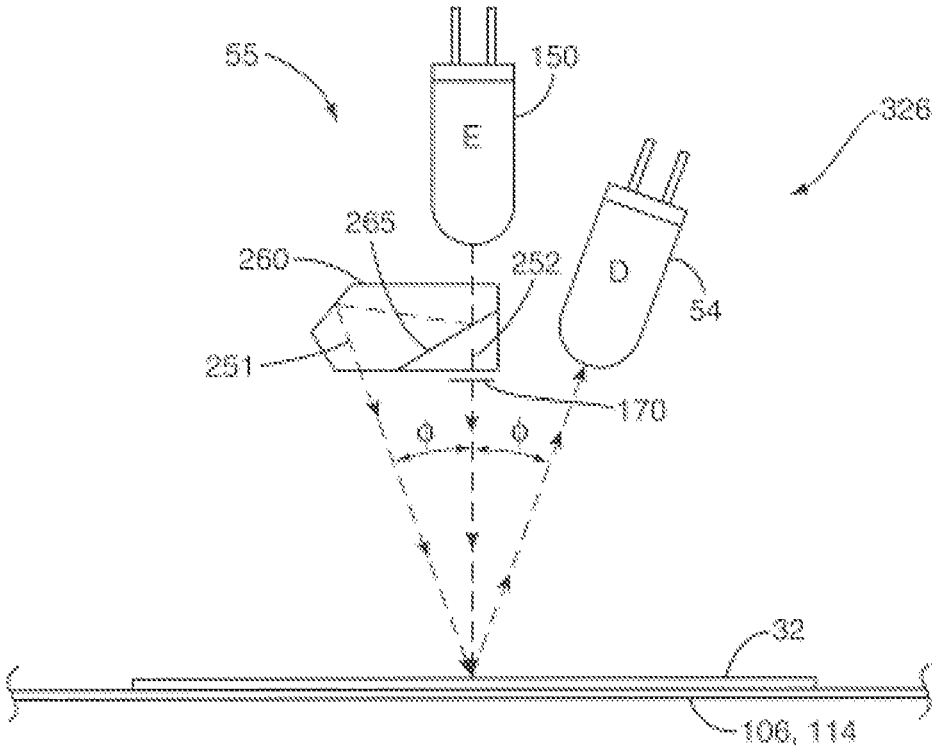
FIG. 9 is a schematic illustration of a toner patch sensor according to one embodiment.

FIG. 9 shows a similar embodiment of a toner patch sensor 326 that includes an optical element 260 having a beam splitter 265. A beam splitter 265 is known in the art as an optical device that splits a beam of light in two, usually by allowing some fraction of the incident light to pass while reflecting some or all of the remaining fraction of the incident light. In the present embodiment, some of the light emitted by the emitter 150 is allowed to pass through the beam splitter along diffuse path 252 while some of the light is reflected along specular path 251. The beam splitter 265 may be optically configured to transmit and reflect in different proportions to adjust the relative amounts of light that are transmitted along each path 251, 252. As with the embodiment shown in FIG. 8, the beam splitter 326 may be configured with a screen 170 that selectively blocks light traveling along the diffuse path 252.

Figure 10:
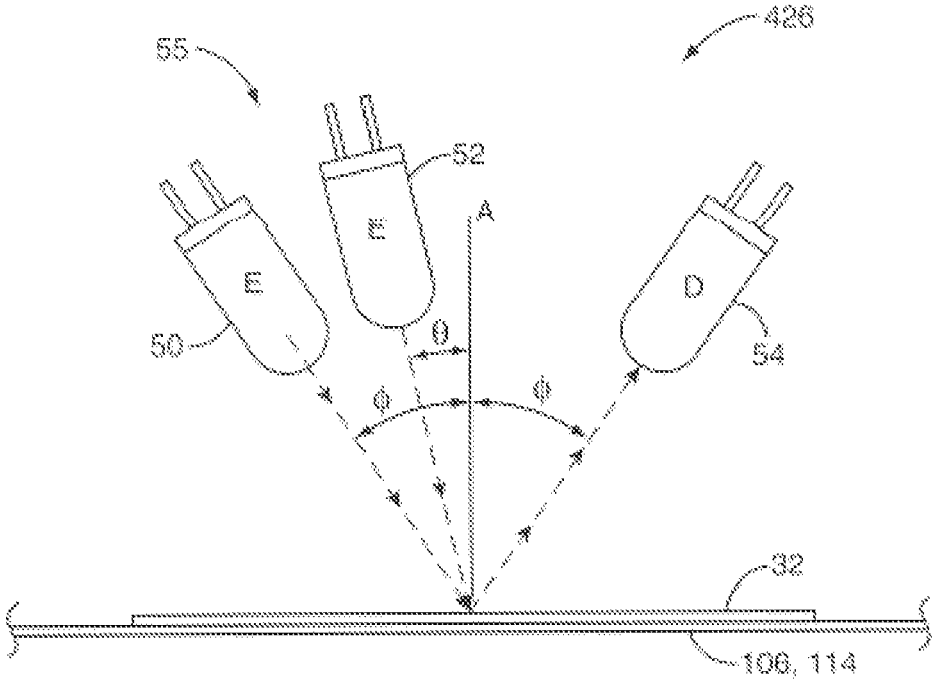
FIG. 10 is a schematic illustration of a toner patch sensor according to one embodiment.

In embodiments described above, the diffuse emitter 52 and the diffuse light paths 152, 252 were oriented to project light along a direction substantially normal to the toner patch 32 (or substrate 106, 114). This is not specifically required. FIG. 10 shows an embodiment of a toner patch sensor 426 where the specular emitter 50 is oriented at an incident angle Φ relative to an axis A normal to the measurement surface (e.g., toner patch 32 or substrate 106, 114) and that is substantially equal to, but opposite a reflectance angle Φ at which the detector 54 is oriented. This aspect of the toner patch sensor 426 is the same as depicted in FIG. 3. However, the diffuse emitted 52 is oriented at some non-zero angle θ such that the incident light from the diffuse emitter 52 is not aligned with the normal axis A.

Figure 11:
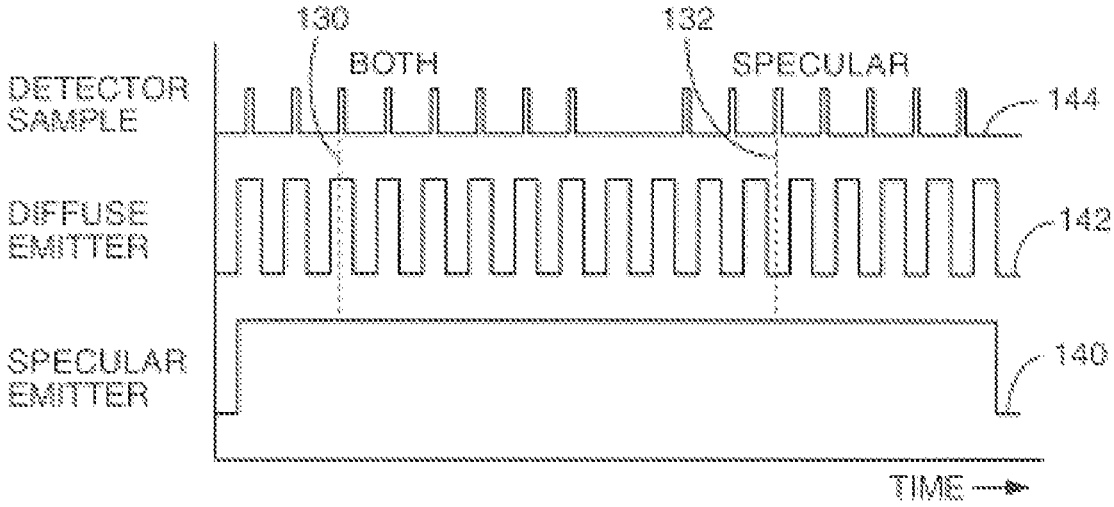
FIG. 11 is a timing diagram illustrating emitter operation and detector sample timing for one embodiment.

When powered, the physical temperature of emitters 50, 52, 150 may increase to elevated operating temperatures. Detector 54 signal samples taken during emitter 50, 52, 150 temperature transients may provide inaccurate results due to variation in light intensity. It may be advantageous to obtain detector 54 samples when the temperature of the emitters 50, 52, 150 has stabilized. However, one embodiment contemplates turning on a diffuse emitter 52 during non-black toner patch sensing and turning off that same diffuse emitter 52 during black toner patch sensing. Consequently, temperature variations may result from turning on and off the diffuse emitter 52 at unequal intervals. To ensure that the temperature of the diffuse emitter 52 does not drift while samples are taken from the detector 54, the diffuse emitter 52 may be modulated to cycle on and off during toner patch sensing. FIG. 11 provides a timing diagram illustrating how the diffuse emitter 52 may be modulated using this approach. Specifically, FIG. 11 shows the timing waveforms 140, 142, 144 for detector 54 sampling, the diffuse emitter 52 modulation, and the specular emitter 50 operation.

In the exemplary timing diagram, waveform 140 reveals that the specular emitter is turned on and remains on for the duration of the toner patch sensing. This includes both non-black (which may include one or more non-black colors, including cyan, magenta, or yellow) and black toner patch sensing. By comparison, waveform 142 is modulated so that the diffuse emitter 52 cycles on and off during toner patch sensing. This modulation may be the same for black and non-black toner patch sensing so the diffuse emitter 52 reaches a consistent operating temperature. In order to achieve the desired operation as described herein, the sample timing given by waveform 144 may be adjusted so that the detector 54 is sampled (at point 130) while both emitters 50, 52 are on for non-black toner patch sensing. Further, the detector 54 is sampled (at point 132) while the diffuse emitter 52 is off (and only the specular emitter 50 is on) for black toner patch sensing. Alternatively, the sampling times may be held constant for black and non-black toner patch sensing with the modulation timing (and not necessarily the duty cycle) of the diffuse emitter 52 adjusted so that the samples 130, 132 are taken at the appropriate times.

Figure 12:
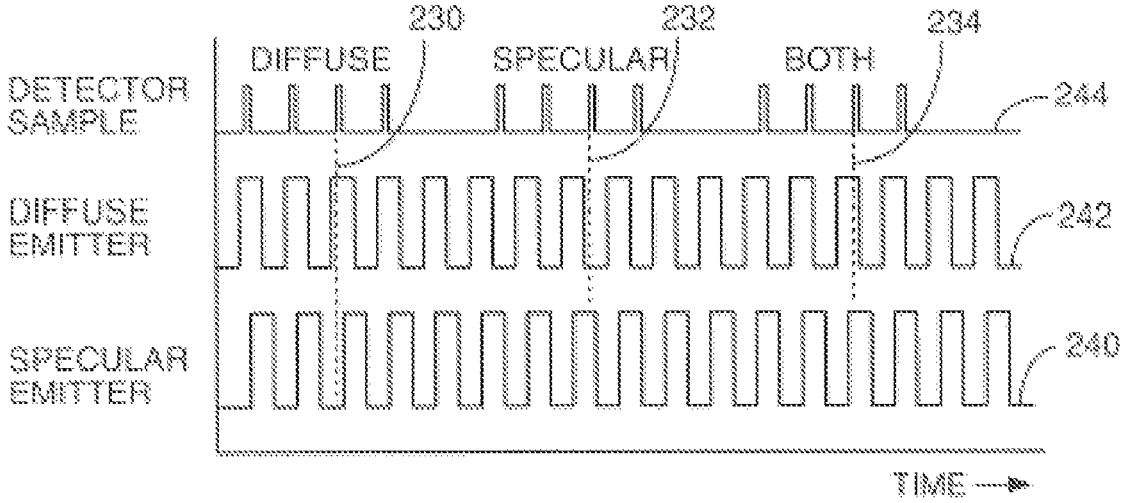
FIG. 12 is a timing diagram illustrating emitter operation and detector sample timing for one embodiment.

FIG. 12 shows an alternative timing diagram illustrating how both the specular emitter 50 and diffuse emitter 52 may be modulated using a similar approach. In this embodiment, the specular emitter 50 and the diffuse emitter 52 may be modulated using similar waveforms 240, 242 that have similar duty cycles and frequencies but are 90 degrees out of phase with respect to each other. The timing of the detector samples 54 may be adjusted so that the reflected light sensed by the detector 54 is obtained from the diffuse emitter 52 (sample 230), the specular emitter 50 (sample 232), or both emitters 50, 52 (sample 234). As above, the sample timing may be held constant and the modulation waveforms 240, 242 adjusted to achieve the desired effect.

The present invention may be carried out in other specific ways than those herein set forth without departing from the scope and essential characteristics of the invention. For example, a single detector 54 is shown in the various embodiments, which may provide a simple advantageous solution. However, the teachings provided herein may be applied to systems where a diffuse emitter is used with a diffuse detector and a specular emitter is used with a specular detector and the outputs from the multiple detectors combined. The present embodiments are, therefore, to be considered in all respects as illustrative and not restrictive, and all changes coming within the meaning and equivalency range of the appended claims are intended to be embraced therein.

What is claimed is:

1. A toner patch sensor for use in an image forming device, the toner patch sensor comprising:

a detector oriented at a first reflection angle relative to a measurement surface; and a source adapted to reflect specular light toward the detector along a second incident angle relative to the measurement surface, the second angle being equal to but opposite the first angle, the source further adapted to reflect diffuse light along a third incident angle relative to the measurement surface, the third angle being different than either the first angle or the second angle, wherein the toner patch sensor further comprises a controller operative to change the amount of one or both of the specular and diffuse light received by the detector, wherein the source comprises a first emitter oriented at the second incident angle relative to the measurement surface and a second emitter oriented at the third incident angle relative to the measurement surface, and wherein the controller selectably adjusts a ratio of illumination power between the first and second emitters.

2. The toner patch sensor of claim 1 wherein the controller selectably turns off one of the first and second emitters.

3. The toner patch sensor of claim 1 wherein the controller selectably positions a screen to block the source for one or both of the specular light and the diffuse light.

4. The toner patch sensor of claim 1 wherein the controller further selectively adjusts a ratio of illumination power between the first and second emitters to intermediate values between substantially no power and substantially full power.

5. A toner patch sensor for use in an image forming device, the toner patch sensor comprising:

a detector oriented at a first reflection angle relative to a measurement surface; and a source adapted to reflect specular light toward the detector along a second incident angle relative to the measurement surface, the second angle being equal to but opposite the first angle, the source further adapted to reflect diffuse light along a third incident angle relative to the measurement surface, the third angle being different than either the first angle or the second angle, wherein the toner patch sensor further comprises a controller operative to chance the amount of one or both of the specular and diffuse light received by the detector, wherein the source comprises a first emitter oriented at the second incident angle relative to the measurement surface and a second emitter oriented at the third incident angle relative to the measurement surface, and wherein the controller selectably modulates an on/off duty cycle for at least one of the first and second emitters synchronously with detection of the received light.

6. The toner patch sensor of claim 5 wherein the controller selectively modulates on/off duty cycles for both the first emitter and the second emitter.

7. The toner patch sensor of claim 6 wherein the duty cycles for the first emitter and the second emitter are out of phase with each other.

8. The toner patch sensor of claim 5 wherein the on/off duty cycle for the at least one of the first and second emitters is substantially constant and sample times by the detector vary.

9. The toner patch sensor of claim 5 wherein the on/off duty cycle for the at least one of the first and second emitters varies and sample times by the detector have a substantially constant frequency.

10. A toner patch sensor for use in an image forming device, the toner patch sensor comprising:

a detector oriented at a first reflection angle relative to a measurement surface; and a source adapted to reflect specular light toward the detector along a second incident angle relative to the measurement surface, the second angle being equal to but opposite the first angle, the source further adapted to reflect diffuse light along a third incident angle relative to the measurement surface, the third angle being different than either the first angle or the second angle, and wherein the source comprises a single emitter and an optical element to split light emitted by the single emitter between the reflected specular light and the reflected diffuse light.

11. An electrophotographic image forming device comprising:

a photoconductive unit;

a charger unit operative to charge a surface of the photoconductive unit to a first voltage;

an imaging unit forming a latent image on the surface of the photoconductive unit by illumination thereof:

a developer roller operative to supply toner to the latent image to form a toner patch;

a substrate onto which the toiler patch is transferred from the surface of the photoconductive unit;

a sensing unit operative to detect a reflectance of the toner patch, the sensing unit including a detector, a first emitter, and a second emitter, the detector oriented to receive an amount of light reflected off the toiler patch from the first and second emitters, at least one of the first and second emitters having a selectable operating state; and a controller operative to change one of a timing at which the detector is observed and the selectable operating state depending on the color of the toner patch to control the amount of light received by the detector originating at one or both of the emitters, and wherein the controller selectably adjusts a ratio of illumination power between the first and second emitters.

12. The image forming device of claim 11 wherein the controller selectably turns one of the first and second emitters off when detecting the reflectance of a black toner patch.

13. The image forming device of claim 11 wherein the controller selectably turns both of the first and second emitters on when detecting the reflectance of a non-black toner patch.

14. The image forming device of claim 11 wherein the first emitter is a specular emitter to reflect specular light towards the detector and the second emitter is a diffuse emitter to reflect diffuse light towards the detector.

15. The image forming device of claim 11 wherein the developed image is a monochrome color patch.

16. The device of claim 11 wherein the controller further selectively adjusts a ratio of illumination power between the first and second emitters to intermediate values between substantially no power and substantially full power.

17. An electrophotographic image forming device comprising:

a photoconductive unit;

a charger unit operative to charge a surface of the photoconductive unit to a first voltage;

an imaging unit forming a latent image on the surface of the photoconductive unit by illumination thereof;

a developer roller operative to supply toner to the latent image to form a toner patch;

a substrate onto which the toner patch is transferred from the surface of the photoconductive unit;

a sensing unit operative to detect a reflectance of the loner patch, the sensing unit including a detector, a first emitter, and a second emitter, the detector oriented to receive an amount of light reflected off the toner patch from the first and second emitters, at least one of the first and second emitters having a selectable operating state; and a controller operative to change one of a timing at which the detector is observed and the selectable operating state depending on the color of the toner patch to control the amount of light received by the detector originating at one or both of the emitters, and wherein the controller selectably modulates an on/off duty cycle for at least one of the first and second emitters.

18. The device of claim 17 wherein the controller selectively modulates on/off duty cycles for both the first emitter and the second emitter.

19. The device of claim 18 wherein the duty cycles for the first emitter and the second emitter are out of phase with each other.

20. The device of claim 17 wherein the on/off duty cycle for the at least one of the first and second emitters is substantially constant and sample times by the detector vary.

21. The device of claim 17 wherein the on/off duty cycle for the at least one of the first and second emitters varies and sample times by the detector have a substantially constant frequency.

22. A toner patch sensor for use in an image forming device, the toner patch sensor comprising:

a detector oriented at a first angle relative to a measurement surface;

a first emitter oriented at second angle relative to the measurement surface, the second angle being equal to, but opposite the first angle, the first emitter oriented to reflect specular light towards the detector;

a second emitter oriented at a third angle relative to the measurement surface, the third angle being different than either the first angle or the second angle, the second emitter oriented to reflect diffuse light towards the detector; and a controller operative to change the amount of light received by the detector from one or both of the first and second emitters, and wherein the controller selectably adjusts a ratio of illumination power between the first and second emitters.

23. The toner parch sensor of claim 22 wherein the controller selectably turns off one of the first and second emitters.

24. The toner patch sensor of claim 22 wherein the controller selectably positions a screen to block light that is transmitted by one or both of the first and second emitters.

25. The toner patch sensor of claim 22 wherein the controller further selectively adjusts a ratio of illumination power between the first and second emitters to intermediate values between substantially no power and substantially full power.

26. A toner patch sensor for use in an image forming device, the toner patch sensor comprising:

a detector oriented at a first angle relative to a measurement surface;

a first emitter oriented at second angle relative to the measurement surface, the second angle being equal to but opposite the first angle, the first emitter oriented to reflect specular light towards the detector;

a second emitter oriented at a third angle relative to the measurement surface, the third angle being different than either the first angle or the second angle, the second emitter oriented to reflect diffuse light towards the detector; and a controller operative to change the amount of light received by the detector from one or both of the first and second emitters, and wherein the controller selectably modulates an on/off duty cycle for at least one of the first and second emitters.

27. The toner patch sensor of claim 26 wherein the controller selectively modulates on/off duty cycles for both the first emitter and the second emitter.

28. The toner patch sensor of claim 27 wherein the duty cycles for the first emitter and the second emitter are out of phase with each other.

29. The toner patch sensor of claim 26 wherein the on/off duty cycle for the at least one of the first and second emitters is substantially constant and sample times by the detector vary.

30. The toner patch sensor of claim 26 wherein the on/off duty cycle for the at least one of the first and second emitters varies and sample times by the detector have a substantially constant frequency.

31. A method of detecting a density of a loner patch on a measurement surface in an image forming device, the method comprising:

directing light along a specular path from an optical source along first angle with respect to a direction normal to the measurement surface to reflect off the toner patch towards a detector disposed at an equal, but opposite angle with respect to the direction normal to the measurement surface;

directing light along a diffuse path from the optical source along a second, different angle with respect to the direction normal to the measurement surface to reflect off the toner patch towards the detector; and in response to the color of the toner patch, selectably adjusting the amount of light that is directed along the diffuse path from the optical source towards the detector wherein the steps of directing light along the specular and diffuse paths from the optical source comprises respectively transmitting light from a specular emitter and a diffuse emitter, and, wherein the step of selectably adjusting the amount of light that is directed along the diffuse path from the optical source towards the detector comprises modulating power that is applied to the diffuse emitter.

32. The method of claim 31 further comprising sampling the detector while the diffuse emitter is off.

33. The method of claim 31 further comprising sampling the detector while the diffuse emitter is on.

34. The method of claim 31 wherein if the toner patch is black, the amount of light that is directed along the diffuse path from the optical source towards the detector is substantially zero.

35. A method of detecting a density of a toner patch on a measurement surface in an image forming device, the method comprising:

directing light along a specular path from an optical source along first angle with respect to a direction normal to the measurement surface to reflect off the toner patch towards a detector disposed at an equal, but opposite angle with respect to the direction normal to the measurement surface;

directing light along a diffuse path from the optical source along a second, different angle with respect to the direction normal to the measurement surface to reflect off the toner patch towards the detector; and an response to the color of the toner patch, selectably adjusting the amount of light that is directed along the diffuse path from the optical source towards the detector, and wherein the steps of directing light along the specular and diffuse paths from the optical source comprises transmitting light from a single emitter and through an optical element and splitting light from the emitter into the specular and diffuse paths.

36. A method of detecting a density of a toner patch on a measurement surface in an image forming device, the method comprising:

directing light along a specular path from a first emitter along a first angle with respect to a direction normal to the measurement surface to reflect off the toner patch towards a detector disposed at an equal, but opposite angle with respect to the direction normal to the measurement surface;

directing light along a diffuse path from a second emitter along a second, different angle with respect to the direction normal to the measurement surface to reflect off the toner patch towards the detector; and selectably adjusting an amount of light sensed by the detector from one or both of the first and second emitters based upon the color of the toner patch, and wherein the step of selectably adjusting the amount of light sensed by the detector from one or both of the first and second emitters further comprises modulating an on/off duty cycle that is applied to at least one of the first and second emitters.

37. The method of claim 36 wherein the step of selectably adjusting the amount of light sensed by the detector from one or both of the first and second emitters further comprises selectably turning off one of the first and second emitters when detecting the reflectance of a black toner patch.

38. The method of claim 37 wherein the second emitter is turned off when detecting the reflectance of a black toner patch.

39. The method of claim 36 wherein the step of selectably adjusting the amount of light sensed by the detector from one or both of the first and second emitters further comprises selectably turning on both the first and second emitters when detecting the reflectance of a toner patch having a color other than black.

40. The method of claim 36 further comprising sampling the detector while one of the emitters is off.

41. The method of claim 36 further comprising sampling the detector while both of the emitters are on.

42. A method of detecting a density of a toner patch on a measurement surface in an image forming device, the method comprising:

directing light along a specular path from a first emitter along a first angle with respect to a direction normal to the measurement surface to reflect off the toner patch towards a detector disposed at an equal, but opposite angle with respect to the direction normal to the measurement surface;

directing light along a diffuse path from a second emitter along a second, different angle with respect to the direction normal to the measurement surface to reflect off the toner patch towards the detector; and selectably adjusting an amount of light sensed by the detector from one or both of the first and second emitters based upon the color of the toner patch, and wherein the step of selectably adjusting the amount of light sensed by the detector from one or both of the first and second emitters further comprises selectably adjusting a ratio of illumination power between the first and second emitters.

* * * * *